US006572246B1

(12) United States Patent
Hopp et al.

(10) Patent No.: US 6,572,246 B1
(45) Date of Patent: Jun. 3, 2003

(54) LIGHTING DEVICE

(76) Inventors: Armin Hopp, Nordstrasse 52, D-53111 Bonn (DE); Dirk Bertelmann, Moltkestrasse 96, D-50859 Cologne (DE)

( * ) Notice: Subject to any disclaimer, the term of this patent is extended or adjusted under 35 U.S.C. 154(b) by 0 days.

(21) Appl. No.: 09/786,395

(22) PCT Filed: Sep. 3, 1999

(86) PCT No.: PCT/DE99/02817

§ 371 (c)(1),
(2), (4) Date: Jul. 9, 2001

(87) PCT Pub. No.: WO00/14447

PCT Pub. Date: Mar. 16, 2000

(30) Foreign Application Priority Data

Sep. 4, 1998 (DE) ..... 198 40 475

(51) Int. Cl.[7] ..... F21V 7/00

(52) U.S. Cl. ..... 362/298; 362/517; 362/302; 362/300; 362/299; 362/305; 362/346

(58) Field of Search ..... 362/517, 298, 362/302, 300, 299, 305, 346

(56) References Cited

U.S. PATENT DOCUMENTS 2,755,374 A * 7/1956 Ott et al.
5,335,158 A * 8/1994 Kaplan et al. ..... 362/303
5,582,480 A * 12/1996 Zwick et al. ..... 362/298

FOREIGN PATENT DOCUMENTS

GB 2310035 * 10/1997 ..... F21P/3/00

* cited by examiner

*Primary Examiner*—Sandra O'Shea
*Assistant Examiner*—Jacob Y. Choi
(74) *Attorney, Agent, or Firm*—Vorys, Sater, Seymour and Pease LLP; Thomas R. Boland

(57) ABSTRACT

In order to develop a lighting apparatus having a light source unit which has at least one light source and a first reflector, and having at least one optical element, with the light which is emitted from the light source being focused by the first reflector to form a light beam which can be influenced by the optical element further, in such a manner that the type of structure, in particular the diameter of the light outlet openings of the lamp housing, does not restrict the optical elements which can be used, said apparatus has a reflector unit having a second reflector and having a concave third reflector, with the concave third reflector having an opening for the light beam and the light beam being reflected by the second reflector onto the third reflector, and with the optical element being arranged between the light source unit and the reflector unit.

10 Claims, 1 Drawing Sheet

LIGHTING DEVICE

Figure 1:
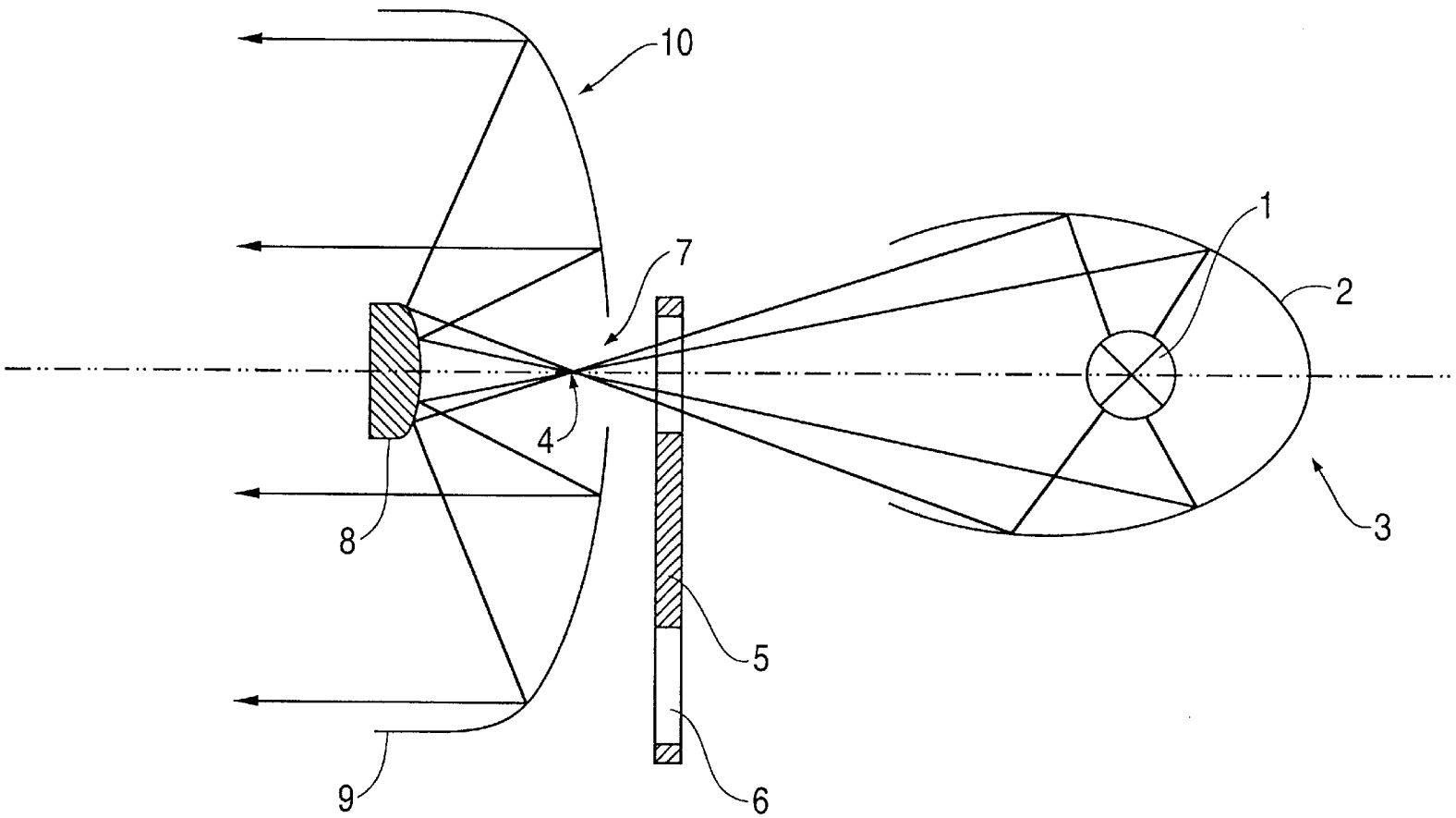

The invention relates to a lighting apparatus having a light source unit which has at least one light source and a first reflector, and having at least one optical element, with the light which is emitted from the light source being focused by the first reflector to form a light beam which can be influenced by the optical element.

Such lighting apparatuses are used, inter alia, for stage lighting. As stage lamps, for example, PAR lamps are known which have a lamp with a parabolic mirror in an aluminum housing and in which a colored filter, for example, can be arranged in front of the light outlet of the lamp in order to achieve a particular visual effect. If different colored filters are intended to be used alternately, motorized filter strips with filter sections of different color can be used. However, these have the disadvantage that they wear rapidly and tear due to the tension load produced by the motor.

Effect disks (Gobos) which can rotate are thus preferably used with different colored filters arranged in the circumferential direction, in which case the filters are not subject to any mechanical tensile load.

One disadvantage of these PAR lamps is that the colored filters which can be used must correspond at least to the diameter of the light outlet opening of the lamp housing in order to completely cover the emerging light beam. If different colored filters are used, the number of colored filters arranged on a filter disk is limited, to avoid exceeding a maximum practical filter disk size.

DE-A 21 33 719 discloses a lamp structure for an operating room light, in which the light of a light source is focused by a parabolic mirror. The start of an optical conductor, consisting of a glass rod, is arranged at the focus of the light beam. The light beams which emerge divergently at the end of the optical conductor are made parallel by a reflector arrangement. The reflector arrangement essentially comprises a prismatic body and a reflector, with the prismatic body deflecting all the light beams emerging from the optical conductor and transmitting them to the reflector such that the light beams are reflected by the reflector, parallel, in the direction of the operating area. The optical conductor in this case passes from the rear area of the reflector through an opening in this reflector and extends to a point shortly in front of the prismatic body.

The particular advantage of such an arrangement is that the distance between the light source and the reflector can be selected as required since a virtually loss-free optical conductor carries the light from the light source to the reflector. This arrangement also achieves the object of fanning out the beams emerging from the light source and of emitting them with virtually the same lighting intensity onto the operating area.

Possible use of other optical elements for influencing the light beam, in particular in order to achieve particular lighting effects, is neither mentioned nor desirable. In fact, such lighting effects are contrary to the purpose of an operating light, namely uniform illumination with a light matched to the daylight spectrum.

This results in the object of the invention, of developing a lighting apparatus in such a manner that the type of construction, in particular the diameter of the light outlet opening of the lamp housing, does not restrict the optical elements which can be used.

In the case of a lighting apparatus of the type mentioned initially, this object is achieved by a reflector unit having a second reflector and having a concave third reflector, with the concave third reflector having an opening for the light beam and the light beam being reflected by the second reflector onto the third reflector, and with the optical element being arranged between the light source unit and the reflector unit.

The lighting apparatus thus has three functional units.

The object of the light source unit is to provide a directed light beam—at least the majority of the light emitted from the light source—with a comparatively small cross-section, at least at one point.

Reflectors which have one focus should preferably be used as the first reflectors. Rotationally symmetrical parabolic mirrors or else rotationally symmetrical reflectors formed like a parabola and whose reflector surfaces rise comparatively steeply from the apex of the reflector and approach again in a region, facing away from the apex, of the optical axis of the light beam to be produced are particularly suitable, such that the angle between the imaginary lines between the apex and two opposite outer edges of the reflector is preferably less than 45°. These reflectors have one focus—even if this focus is not sharp.

The light beam can then be influenced in a region of the light beam with a small cross section by means of an optical element or a number of optical elements arranged one behind the other.

The optical elements may be not just colored filters or else shutters, but any types of optical elements may be mentioned, provided they do not widen the light beam by more than a specific extent.

The light beam is then widened to the desired cross-sectional area in the reflector unit arranged behind the optical element. In this case, the light beam is first of all reflected back from the second reflector onto the concave third reflector, which reflects the light beam, which has then been widened, out of the lighting apparatus. To this end, the second reflector may preferably be convex or else planar, although any other reflector shape which widens the light beam is also feasible.

One advantage of the apparatus according to the invention over the prior art is thus that the optical elements to be used can be comparatively small owing to the small cross section of the light beam before the reflector unit, and the production costs for these elements of a lighting apparatus can thus be minimized.

A further advantage is that the functional separation of the production of a directed light beam and its optical processing result in considerably greater freedom in the physical design of the necessary apparatus housing, with regard to the heat dissipation that is required. This is particular advantageous if the light sources used are high-power lamps, which operate at a very high operating temperature.

A corresponding situation applies to the heat which may need to be dissipated on the optical element itself, and which arises from the absorption of light.

In one preferred embodiment of the invention, the first reflector is designed in the form of an ellipsoid which is open on one side, with the light source being formed in the region of the first focus of the reflector and the light beam converging at a second focus.

A reflector such as this, which is preferably integral, allows the light beam to be focused very accurately in a simple manner, without additional optical elements being required.

The optical element to be used can be particularly small in this embodiment, provided it is arranged in the region of the second focus. The optical element can also be arranged just as well in front of or behind the second focus, or else a number of optical elements can be arranged in front of, at, and/or behind the focus.

If the light beam which is widened behind the second focus passes through the concave third reflector, the second reflector can be planar.

In one preferred development of this embodiment, a lens is arranged at the distance of its focal length behind the second focus. This lens allows the light beam to be made parallel so that the distance between the lens and the reflector unit can be of virtually any desired size. A large number of optical elements can thus easily be arranged one behind the other between the lens and the reflector unit.

In another preferred embodiment, the distance between the second reflector and the third reflector is adjustable.

This allows the extent to which the light beam is widened to be varied.

In a further preferred refinement, the lighting apparatus has a device for positioning one or more optical elements.

For example, this device for positioning one or more optical elements may be an effect disk mounted such that it can rotate. The effect disk can thus be rotated in order to change from one optical element to another. Movie-like image sequences can also be produced by passing through different optical elements with a constantly rotating effect disk.

In the simplest embodiment, the effect disk has only one through-opening and is other wise opaque. The effect disk can thus be used as a switchable shutter in order to allow the light beam either to pass through completely or to be blocked completely.

In order to achieve as high a level of reflection as possible, the reflectors can be mirrored. This can be done by vapor deposition of a metal layer on the reflectors.

On the other hand, it is advantageous for the reflectors to be formed from a material containing aluminum. The reflection characteristics of aluminum are such that mirroring can be dispensed with, in order to minimize production costs. In order to achieve improved reflection characteristics with aluminum, the reflector surfaces should be polished.

Such reflectors can be drawn from an aluminum sheet.

In a further advantageous refinement, the first reflector and the third reflector are each formed integrally with an essentially cylindrical housing wall, and the housing walls can be connected to one another via a push fit. In this way, the reflector housing can be produced as easily as possible, and the individual parts can be assembled easily.

The invention will be explained in more detail in the following text with reference to FIG. 1, which illustrates the principle of the invention.

FIG. 1 shows the principle of the lighting apparatus according to the invention having a light source unit 3 which has at least one light source 1 and a first reflector 2. The reflector 2 is in the form of a rotationally symmetrical ellipsoid which is open on one side, with the light source 1 forming a first focus of the ellipsoid, and the light being focused at a second focus 4.

An effect disk 5 with optical elements 6 projects into the light beam in front of the focus 4.

The light beam passes through an opening 7 through a rotationally symmetrical concave third reflector 9 and is widened by a second, convex, rotationally symmetrical reflector 8 and is deflected onto the third reflector 9, from where the now widened light beam is reflected out of the lighting apparatus. The second and third reflectors 8, 9 form the reflector unit 10.

The rotationally symmetrical configuration of the mirrors and reflectors 2, 8 and 9 is particularly advantageous for point light sources since this results in comparatively uniform distribution of the light intensity over the cross section of the light beam.

Nevertheless, the mirrors and reflectors need not necessarily be rotationally symmetrical. In the case of an essentially linear light source, for example like a fluorescent tube, the mirrors and reflectors 2, 8 and 9 may be area-symmetrical.

What is claimed is:

1. A lighting apparatus comprising, a light source unit (3) comprising, at least one light source (1), and an ellipsoidal first reflector (2), said ellipsoidal first reflector (2) having a first focus and an aperture generally opposite said first focus, said light source being located generally in the vicinity of said first focus, whereby light emitted from said light source is focused to form a light beam;

a reflector unit (10) comprising a second reflector (8), and a concave third reflector (9), said third reflector (9) having an opening (7) to admit said light beam, and said second reflector (8) positioned to reflect said light beam onto said third reflector (9), said second reflector (8) and said third reflector (9) being separated by a distance, and an optical element (6) positioned between said light source unit (3) and said reflector unit (10);

said light source unit (3) and said reflector unit (10) being positioned so that said light beam converges at a second focus (4) located between said first reflector (2) and said second reflector (8).

2. The lighting apparatus as claimed in claim 1, additionally comprising a lens positioned opposite said second focus (4) and at a distance therefrom equal to a focal length of said lens.

3. The lighting apparatus as claimed in claim 1 or claim 2, wherein said distance between said second reflector (8) and said third reflector (9) is adjustable.

4. The lighting apparatus as claimed in claim 1 or claim 2, additionally comprising apparatus for positioning one or more of said optical elements (6).

5. The lighting apparatus as claimed in claim 4, wherein said apparatus for positioning one or more of said optical elements (6) is a rotatable effect disk.

6. The lighting apparatus as claimed in claim 1 or claim 2, wherein said first, second, and third reflectors (2, 8, 9) are mirrors.

7. The lighting apparatus as claimed in claim 1 or claim 2, wherein said first, second, and third reflectors (2, 8, 9) are formed from a material containing aluminum.

8. The lighting apparatus as claimed in claim 7, wherein said first, second, and third reflectors (2, 8, 9) are drawn from an aluminum sheet.

9. The lighting apparatus as claimed in claim 1 or claim 2, wherein said first reflector (2) is formed integrally with a first substantially cylindrical housing wall and said third reflector (9) is formed integrally with a second substantially cylindrical housing wall, said first and second substantially cylindrical housing walls being dimensioned to permit a sliding interconnection between said first and second substantially cylindrical housing walls.

10. The lighting apparatus of claim 1 wherein said second reflector (8) and said third reflector (9) are arranged to expand said light beam.

* * * * *